US006715494B1

(12) United States Patent
McCoy

(10) Patent No.: US 6,715,494 B1
(45) Date of Patent: Apr. 6, 2004

(54) TWO-PIECE SMOKING PIPE VAPORIZATION CHAMBER WITH DIRECTED HEAT INTAKE

(76) Inventor: Mark Scott McCoy, 100 Harborseal Ct., San Mateo, CA (US) 94404

( * ) Notice: Subject to any disclaimer, the term of this patent is extended or adjusted under 35 U.S.C. 154(b) by 0 days.

(21) Appl. No.: 10/054,617

(22) Filed: Nov. 9, 2001

Related U.S. Application Data

(63) Continuation of application No. 09/365,391, filed on Aug. 2, 1999, now Pat. No. 6,354,301.

(51) Int. Cl.[7] ..... A24F 13/04

(52) U.S. Cl. ..... 131/194; 131/229; 131/222; 131/226; 131/210; 131/330; D27/164; D27/167; 128/202.21; 128/203.12

(58) Field of Search ..... 131/329, 216, 131/222, 225, 226, 193, 227, 229, 224, 210, 330, 194, 173; D27/164, 166, 167, 168, 169, 163; 128/202.21, 203.12

(56) References Cited

U.S. PATENT DOCUMENTS

| | | | | | |
|---|---|---|---|---|---|
| 719,683 | A | | 2/1903 | Moehlenbrook | 131/196 |
| 933,360 | A | * | 9/1909 | Carabias | 128/202.21 |
| 972,737 | A | | 10/1910 | Tobias | 131/184.2 |
| 1,313,280 | A | | 8/1919 | Falkenau | 131/198.1 |
| 1,957,143 | A | | 5/1934 | Kretzner | 131/12 |
| 2,129,129 | A | * | 9/1938 | Groulx | 131/224 |
| 2,360,628 | A | | 10/1944 | Wright | 131/211 |
| 3,079,928 | A | | 3/1963 | Jensen | 131/201 |
| 3,750,677 | A | | 8/1973 | Jodoin | 131/328 |
| 3,863,647 | A | * | 2/1975 | Unger | 131/179 |
| 4,224,953 | A | | 9/1980 | Alvarez | 131/179 |
| 5,993,748 | A | | 11/1999 | Wheeler | 422/125 |

* cited by examiner

*Primary Examiner*—Steven P. Griffin
*Assistant Examiner*—Dionne A. Walls
(74) *Attorney, Agent, or Firm*—Sierra Patent Group, Ltd.

(57) ABSTRACT

A method of using a two-piece smoking pipe vaporization chamber with directed heat intake is disclosed comprising applying a material from which vapor is to be extracted over the surface of a lower screen member. The method further comprises forming a vaporization chamber by combining a lower chamber member and an upper chamber member and coupling the vaporization chamber with a delivery vessel. The method also includes adjusting a heat gun to a predetermined temperature and inserting a discharge nozzle of the heat gun into the upper chamber member. The method includes warming the material from which vapor is to be extracted to cause a vapor to be extracted from the material from which vapor is to be extracted and inhaling the vapor from the delivery vessel.

7 Claims, 2 Drawing Sheets

TWO-PIECE SMOKING PIPE VAPORIZATION CHAMBER WITH DIRECTED HEAT INTAKE

PRIORITY CLAIM

The following application is a continuation of an allowed U.S. patent application, Ser. No. 09/365,391, filed Aug. 2, 1999, Now U.S. Pat. No. 6,354,301, entitled "Two-Piece Smoking Pipe Vaporization Chamber With Directed Heat Intake." A relevant disclosure of the present art was previously filed on Apr. 20, 1999 by the inventor, Mark S. McCoy, and is referenced by the U.S. Patent and Trademark Office as Disclosure Document No. S00986.

BACKGROUND OF THE INVENTION

Field of the Invention

The current use of cigarettes or smoking pipes for the inhaling of cannabinoids, nicotine, and other active constituents of commonly smoked herbal materials is recognized as delivering numerous irritants and possible carcinogens along with the desired active principles to the tracheobronchial tree and oral cavity. Vaporization, the temperature range of which is represented by the boiling points of the desired active constituents, occurs significantly below the flash point and pyrrolytic temperature of both the active and non-active components of commonly smoked materials, and thus, as a delivery medium, separates out the more therapeutic and active chemical components from the crude plant or resin impurities and breakdown products of pyrrolsis. The commonly used means by which to vaporize traditionally smoked materials include various heating element heated trays with collection bubbles that effectively vaporize the active constituents out of the traditionally smoked materials, but do so in a manner which is not conducive to popular use for three significant reasons: 1) use of such devices radically alters the smoking ritual and process both medical and recreational users have come to appreciate and are familiar with, and 2) the heated surface, or vapor tray, in contact with the traditionally smoked material as a means of heating it to the necessary temperature for vaporization combined with the fact that the vapor is collected and stored momentarily prior to inhalation creates an undesirable taste that is unattractive to users, and 3) the momentary storage of the vapor within the collection bubble of such devices allows a prolonged process of oxidation to occur which can undesirably alter the chemical make-up of the active chemical components. Heat guns have also been used with limited success for the purpose of vaporization of active chemical components in commonly smoked materials by simply directing the heated air flow at the traditionally smoked material in one of many designs of a common smoking bowl on a commonly used smoking pipe. Although this technique addresses both the loss of ritual and vapor taste issues found with the heating tray with collection bubble type vaporization devices it has only met with limited success as effectiveness varies greatly dependent upon the particular pipe bowl design being used, the level of intake suction, and the total volume of inhalation attainable by the user. In general, using a heat gun with currently available pipe bowls for the purpose of vaporization of traditionally smoked materials requires a great deal more intake suction and a much longer inhalation draw than smoking of the same material, and thus is unattainable by some users especially those with medical conditions, and also presents the complication of smoke material being blown out of the bowl by the propelled heat air flow from the heat gun.

SUMMARY OF THE INVENTION

The present invention is designed to successfully address these shortcomings by increasing the attainable effectiveness of the heat gun technique of vaporization, and thus; improve the therapeutic utility, convenience, economics, and desirability of vaporization as an alternative to smoking. This invention relates to various smoking pipe devices, but is of novel design and original conception. Specifically it enables the smokeless vaporization of the active constituents of commonly smoked materials to occur in a manner conducive to popular use as it is designed to be used in conjunction with common pipe designs currently in use by replacing the standard bowl used for smoking and using temperature controlled hot air from a heat gun directed into its intake in lieu of flame from a lighter or match. This would be helpful for people with immune deficiencies using cannabis medically as it would enable the delivery of the cannabinoids to the tracheobronchial tree via the oral cavity without the numerous irritants and possible carcinogens contained within the smoke while still maintaining the convenience and familiarity of conventional smoking techniques. It would also be helpful for recreational users of cannabis, tobacco, and other herbal blends that are commonly smoked as it would provide a safer, more desirable, alternative means of delivery of the active principles without radically changing the process by which they engage in the activity of smoking as is required by the use of more elaborate vaporization devices. It would also be helpful to both groups mentioned above by delivering substantially more of the active constituents than is possible with conventional smoking techniques, and thus, would represent a significant economic improvement.

To attain this, the present invention provides a two-piece smoking pipe vaporization chamber with directed heat intake designed to be used in conjunction with various smoking pipe designs and a heat gun with adequate temperature control. The apparatus, the instant invention of which is designed to connect at the point of the bowl attachment to the various conduits of commonly used and available smoking pipes and apparatuses, consists of a bowl with a projecting conduit either externally threaded for point of attachment with threaded-type pipe conduits or simply elongated and fitted with an o-ring for compatibility with slider-type pipe conduits that has a screened vapor intake like is common as a smoke intake orifice on most pipe bowls and is threaded, tapered, or otherwise shaped in a male manner on the upper, outer bowl surface to accept an upper chamber forming top fitting heat intake housing that serves to cap the lower portion in an air-tight, chamber forming manner and houses a heat intake orifice in conduit enabled communication with a flanged heat intake intended to accept the output nozzle of a heat gun. The invention resides not in any one of these features per se, but rather in the particular combination, both mechanically and functionally, of all of them herein disclosed and claimed, and it is distinguished from any related prior art that it is intended to be operated in conjunction with or that exhibits any common characteristics, as it is of completely unique device and novel design in overall terms of function and is intended for either completely different applications or similar applications with a substantially greater level of convenience and desirability to the user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as basis for the designing of other structures, methods and systems for carrying out the general purpose of the present invention. Such variations are likely to include, but should not be considered as limited to, various air flow valve assembly options, and angles of intersection of the chambers housing and heat intake being compensatory to other angles of heat gun air flow output than is proposed and illustrated, or for sources of sufficiently heated air flow other than a conventional heat gun. Other variations are likely to include various bore altering rifling intended to create air flow turbulence within the vaporization chamber and external handles for ease of handling. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is intended to be limiting as to the scope of the invention in any way.

It is therefore an object of the present invention to provide a two-piece smoking pipe vaporization chamber with directed heat intake of completely novel design and intended to work in conjunction with, and broaden the range of use for many forms of commonly used smoking pipes and smoking apparatuses.

It is another object of the present invention to provide a two-piece smoking pipe vaporization chamber with directed heat intake with many advantages and benefits over traditional smoking and other means of vaporization, while maintaining the cost effectiveness, convenience, and desirability of operation to enable accessibility by the general public and that can be easily manufactured and marketed.

It is a further object of the present invention to be of a basic design to enable durable and reliable construction out of a variety of materials.

An even further object of the present invention is to provide a useful two-piece smoking pipe vaporization chamber with directed heat intake which is susceptible of low cost of manufacture with regard to both materials and labor, and which accordingly is then susceptible of low prices of sale to the consuming public, thereby making such two-piece smoking pipe vaporization chamber with directed heat intake economically available to the buying public.

Still yet another object of the present invention is to provide a useful two-piece smoking pipe vaporization chamber with directed heat intake which provides in the apparatuses and methods of commonly used smoking pipes and smoking apparatuses which the present invention is intended to be used in conjunction with the purposes and advantages thereof, while simultaneously offering the selective broadening of the range of uses therewith.

These together with other objects and methods of the present invention, along with the overriding feature of novelty which characterizes the present invention, are pointed out with particularity in the claims annexed to and forming a part of this disclosure. For a better understanding of the invention, its methods, operating capabilities, and specific objects attained by its uses, reference should be had to the accompanying drawings and descriptive matter wherein there is illustrated the embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION THE INVENTION

Figure 1:
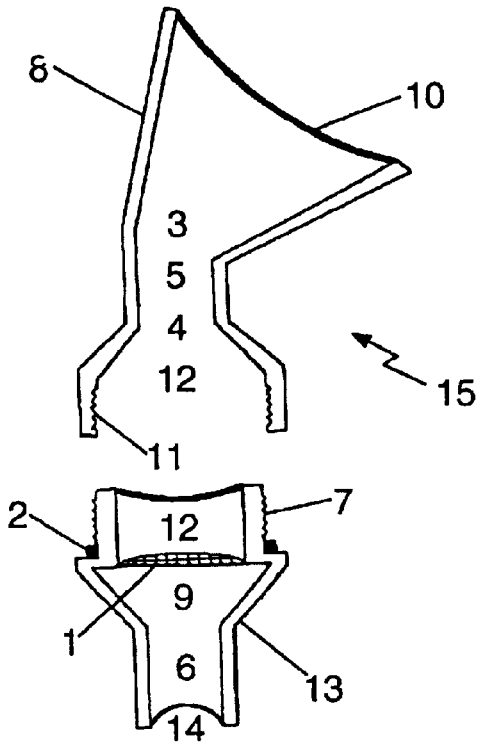
FIG. 1 is a separated orthographic cross-sectional view of the invention offering an exposed perspective of the internal features of the instant embodiment and includes a complete orthographic inventory of the internal and external components of the invention.
Figure 2:
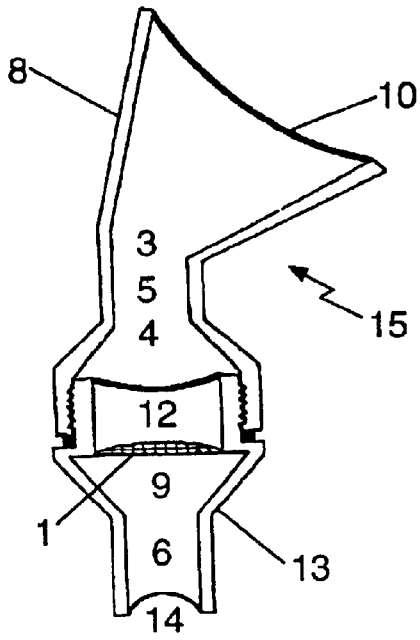
FIG. 2 is an assembled orthographic cross-sectional view of the invention in operational prepared mode offering an exposed perspective of the internal features of the instant embodiment.
Figure 3:
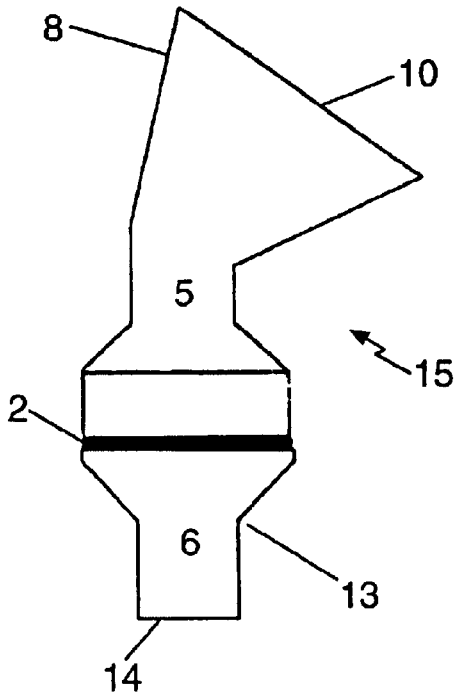
FIG. 3 is an assembled orthographic view of the invention in operational prepared mode offering an assembled external perspective.

With reference now to the drawings, and in particular to FIGS. 1 to 3 thereof, a novel two-piece smoking pipe vaporization chamber with directed heat intake embodying the principles and concepts of the present invention and generally designated by the reference numeral 15 will be described.

In FIGS. 1 through 4, schematic type drawings are utilized to represent the embodiments of the present invention.

In FIG. 1 the separated, exposed cut-away perspective offers a complete orthographic inventory of the internal and external components of the present invention 15 which include the lower chamber forming bowl 13 in communication with a vapor intake conduit 6 that feeds to the vapor output orifice 14 and is intended to be manufactured with either external threads as a means of attachment to threaded-type pipe conduits or a simple elongation of said vapor intake conduit 6 with an externally fitted o-ring for slider-type pipe conduits via a vapor intake orifice 9 that is not unlike the smoke intake orifices common on most smoking pipe bowls which is screened with a screen 1 and is threaded in a male manner on the upper, outer bowl surface 7 to accept the female threaded portion 11 of an upper chamber forming heat intake housing 8 that serves to cap the lower chamber forming bowl 13 in an air-tight manner when threaded together enough to partially compress a sealing o-ring 2 forming a vaporization chamber 12 and houses a lower heat intake orifice 4 in communication with an angled heat intake conduit 5 that communicates via an upper heat intake orifice 3 with a flanged heat intake 10 intended to accept the output nozzle of a heat gun.

In FIG. 2 the assembled, exposed cut-away perspective offers an operationally viable view. The traditionally smoked material of choice would be contained within the bowl portion of the lower chamber forming bowl 13 atop the screen 1 which as shown enclosed by the upper chamber forming heat intake housing 8 forms a vaporization chamber 12 wherein operational mode the traditionally smoked material would be exposed to the heated air flow from a heat gun the nozzle of which is user directed into the flanged heat intake 10 creating a directed heat intake consisting of the upper heat intake orifice 3 in communication with the heat intake conduit 5 in communication with the lower heat intake orifice 4 which communicates directly with the vaporization chamber 12 whereas the heated air flow would be user maintained until the active constituents reach their respective boiling points and are released as vapor that is concurrently drawn by the suction created by the user drawing on the mouthpiece of the modified conventional smoking pipe, as if smoking, through the screen 1, effectively separating the vapor from the plant material, through the vapor intake orifice 9 and down the vapor intake conduit 6 and out the vapor output orifice 14 into the aptly modified conventional smoking pipe body where it is directed to and eventually inhaled by the user.

In FIG. 3 the assembled perspective offers a view of the external surface features of the apparatus in operationally prepared mode. The bowl portion of the lower chamber forming bowl 13 is enclosed by the upper chamber forming heat intake housing 8 with the two pieces threaded together enough to adequately compress the o-ring 2 forming an airtight seal. The external surface view of important features of the upper chamber forming heat intake 8 is offered including the flanged heat intake 10 and the heat intake conduit 5. The external surface view of important features of the lower chamber forming bowl 13 is also offered including the vapor intake conduit 6 which would be manufactured with either external threads for attachment to threaded-type smoking pipe conduits or simply elongated and fitted with an external o-ring for compatibility with slider-type smoking pipe conduits and the vapor output orifice 14 which represents the point at which the desired vapor would exit the present art entering the aptly modified conventional smoking pipe body whereas it would be directed to the user for inhalation.

Figure 4:
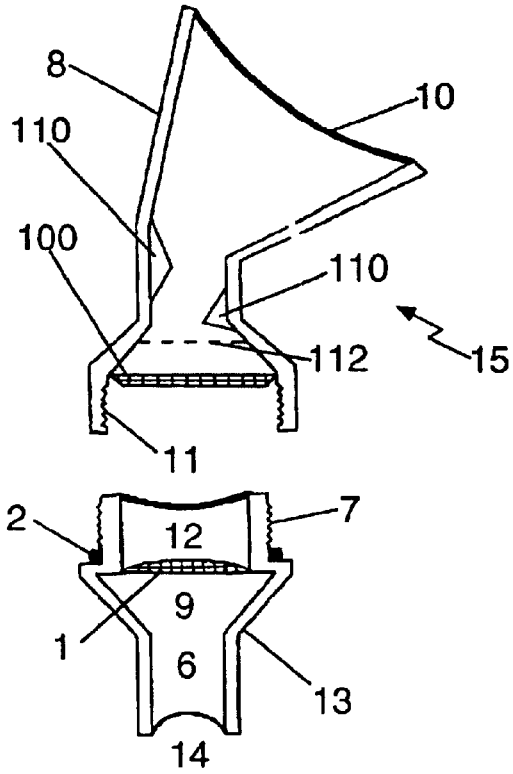
FIG. 4 is a separated orthographic cross-sectional view of the invention offering an exposed perspective of the internal features of an exemplary embodiment.

In FIG. 4, the separated, exposed cut-away perspective offers an orthographic inventory of the internal and external components of an alternative embodiment of the present invention. The features embodied in FIG. 4 are similar to the features embodied in FIG. 1 with the addition of features. Included in the embodiment shown in FIG. 4 is a second screen or upper screen 100 disposed in the upper chamber forming heat intake housing or member 8 and the lower chamber forming bowl or bowl portion 13. Also shown in FIG. 4 are heated intake air turbulence members 110 disposed between the heat intake orifice 3 and the vapor intake orifice 9. The bore of one or more of the components and related orifices can be rifled or otherwise altered to intentionally create various forms of heated intake air turbulence within the vaporization chamber while in operational mode. In yet another embodiment, the heated intake air turbulence member can be an impeller 112 disposed between the heat intake orifice 3 and the vapor intake orifice 9. The impeller 112 can be a small turbine-like wheel and vanes within the bore or one or more of the components or related orifices.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since to those skilled in the art, it is not desired to limit the invention to exact construction and operation shown and described, and accordingly, all suitable alterations and equivalents may be resorted to, falling within the scope of the invention.

What is claimed is:

1. A two-piece smoking pipe vaporization chamber with directed heat intake comprising in combination:

a lower chamber member having a bowl portion formed therein to hold materials from which vapor is to be extracted, said bowl portion communicating with a vapor intake conduit at a vapor intake orifice thereof disposed below said bowl portion, said vapor intake conduit adapted to mate with a smoking pipe conduit;

a lower screen member disposed in said bowl portion of said lower chamber member over said vapor intake orifice;

an upper chamber member adapted to mate with said lower chamber portion in a substantially air-tight manner to form a vaporization chamber, said upper chamber member including a generally-conical-shaped heat intake conduit communicating therewith and having a heat intake orifice at a distal end thereof and adapted to accept output from a heat source; and at least one heated intake air turbulence member comprising an impeller disposed between said heat intake orifice and said vapor intake orifice.

2. The two-piece smoking pipe vaporization chamber of claim 1 wherein said heat intake aperture is adapted to accept an output nozzle of a heat gun.

3. The two-piece smoking pipe vaporization chamber of claim 1 wherein said vapor intake conduit projects downwardly from said lower chamber member.

4. The two-piece smoking pipe vaporization chamber of claim 1 wherein said upper chamber member is adapted to mate with said lower chamber member by threads disposed on mating surfaces of said upper chamber member and said lower chamber member.

5. The two-piece smoking pipe vaporization chamber of claim 1 wherein said upper chamber member includes an internal tapered surface and said lower chamber member includes an external mating tapered surface.

6. A two-piece smoking pipe vaporization chamber with directed heat intake comprising in combination:

a lower chamber member having a bowl portion formed therein to hold materials from which vapor is to be extracted, said bowl portion communicating with a vapor intake conduit at a vapor intake orifice thereof disposed below said bowl portion, said vapor intake conduit adapted to mate with a smoking pipe conduit:

a lower screen member disposed in said bowl portion of said lower chamber member over said vapor intake orifice;

an upper chamber member adapted to mate with said lower chamber portion in a substantially air-tight manner to form a vaporization chamber, said upper chamber member including a generally-conical-shaped heat intake conduit communicating therewith and having a heat intake orifice at a distal end thereof and adapted to accept output from a heat source; and at least one heated intake air turbulence member disposed between said heat intake orifice and said vapor intake orifice above said lower screen member.

7. A two-piece smoking pipe vaporization chamber with directed heat intake comprising in combination:

a lower chamber member having a bowl portion formed therein to hold materials from which vapor is to be extracted, said bowl portion communicating with a vapor intake conduit at a vapor intake orifice thereof disposed below said bowl portion, said vapor intake conduit adapted to mate with a smoking pipe conduit;

a lower screen member disposed in said bowl portion of said lower chamber member over said vapor intake orifice;

an upper chamber member adapted to mate with said lower chamber portion in a substantially air-tight manner to form a vaporization chamber, said upper chamber member including a generally-conical-shaped heat intake conduit communicating therewith and having a heat intake orifice at a distal end thereof and adapted to accept output from a heat source; and an upper screen disposed in said upper chamber member and positioned above said bowl portion.

* * * * *